US011756516B2

(12) United States Patent
DeWall

(10) Patent No.: US 11,756,516 B2
(45) Date of Patent: Sep. 12, 2023

(54) ANATOMICAL RANDOM RHYTHM GENERATOR

(71) Applicant: Matthew DeWall, San Diego, CA (US)

(72) Inventor: Matthew DeWall, San Diego, CA (US)

( * ) Notice: Subject to any disclaimer, the term of this patent is extended or adjusted under 35 U.S.C. 154(b) by 197 days.

(21) Appl. No.: 17/116,011

(22) Filed: Dec. 9, 2020

(65) Prior Publication Data

US 2022/0180848 A1 Jun. 9, 2022

(51) Int. Cl.
*G10H 1/00* (2006.01)
*G10H 1/42* (2006.01)
*G10H 1/36* (2006.01)

(52) U.S. Cl.
CPC ..... *G10H 1/0025* (2013.01); *G10H 1/361* (2013.01); *G10H 1/42* (2013.01)

(58) Field of Classification Search
CPC ..... G10H 1/0025; G10H 1/361; G10H 1/42
USPC ..... 84/609
See application file for complete search history.

(56) References Cited

U.S. PATENT DOCUMENTS 3,629,480 A * 12/1971 Harris ..... G10H 1/42 84/DIG. 12
3,958,483 A * 5/1976 Borrevik ..... G10H 1/40 84/DIG. 12
RE28,999 E * 10/1976 Southard ..... G10H 1/40 84/651
4,208,938 A * 6/1980 Kondo ..... G10H 1/40 84/DIG. 12
5,434,350 A * 7/1995 Haney ..... G10H 1/32 84/730
5,484,957 A * 1/1996 Aoki ..... G10H 1/36 84/DIG. 12
6,121,533 A * 9/2000 Kay ..... G10H 1/0091 84/DIG. 12
7,169,997 B2 * 1/2007 Kay ..... G10H 1/02 84/611
7,183,480 B2 * 2/2007 Nishitani ..... A63B 71/0686 84/723
7,491,878 B2 * 2/2009 Orr ..... G10H 1/0025 84/649
7,790,974 B2 * 9/2010 Sherwani ..... G10H 1/0025 84/609
7,842,879 B1 * 11/2010 Carter ..... G10H 3/143 84/730
8,566,258 B2 * 10/2013 Pachet ..... G06N 7/01 706/12

(Continued)

FOREIGN PATENT DOCUMENTS

CN 1637743 A * 7/2005 ..... G06F 16/635
EP 1994525 11/2008

(Continued)

*Primary Examiner* — Christina M Schreiber
(74) *Attorney, Agent, or Firm* — Buche & Associates, P.C.; John D. Buche; Bryce A. Johnson

(57) ABSTRACT

Disclosed is a random music or rhythm generator comprised of software and hardware that serves to augment the creativity of human musicians when creating musical compositions. The generator considers anatomical restrictions when creating music in order to generate humanly playable musical compositions. The generator also features extra components and features which allow musicians to configure, customize, randomize, and share their musical compositions.

6 Claims, 9 Drawing Sheets

(56) References Cited

U.S. PATENT DOCUMENTS

| | | | | |
|---|---|---|---|---|
| 8,812,144 | B2 * | 8/2014 | Balassanian | G10H 1/0025 381/119 |
| 9,251,776 | B2 * | 2/2016 | Serletic, II | G10H 1/0025 |
| 10,453,434 | B1 * | 10/2019 | Byrd | G10L 25/18 |
| 10,679,596 | B2 * | 6/2020 | Balassanian | G06F 16/68 |
| 2001/0015123 | A1 * | 8/2001 | Nishitani | G10H 1/00 84/615 |
| 2002/0177997 | A1 * | 11/2002 | Le-Faucheur | G10H 7/08 704/208 |
| 2003/0068053 | A1 * | 4/2003 | Chu | G10H 1/0008 381/118 |
| 2009/0114079 | A1 * | 5/2009 | Egan | G09B 15/023 84/477 R |
| 2009/0164034 | A1 * | 6/2009 | Cohen | G10H 1/0025 700/94 |
| 2011/0191674 | A1 * | 8/2011 | Rawley | G06F 3/016 715/702 |
| 2012/0312145 | A1 * | 12/2012 | Kellett | G10H 1/38 84/613 |
| 2015/0221297 | A1 * | 8/2015 | Buskies | G10H 1/0066 84/611 |
| 2016/0365078 | A1 * | 12/2016 | Sims | G10D 13/26 |
| 2022/0180848 | A1 * | 6/2022 | DeWall | G10H 1/42 |

FOREIGN PATENT DOCUMENTS

| | | | | |
|---|---|---|---|---|
| EP | 1994525 | B1 * | 10/2016 | G10H 1/0025 |
| JP | 07230284 | A * | 8/1995 | |
| JP | H07230284 | | 8/1995 | |
| WO | 2006011342 | | 2/2006 | |
| WO | 2009107137 | | 9/2009 | |
| WO | 2019158927 | | 8/2019 | |

* cited by examiner

| Track number | Percussion sound | limb |
|---|---|---|
| Track 1 | Kick Drum 1 | Leg |
| Track 2 | Kick Drum 2 | Leg |
| Track 3 | Snare Drum 1 | Arm |
| Track 4 | Snare Drum 2 | Arm |
| Track 5 | Crash Cymbal 1 | Arm |
| Track 6 | Crash Cymbal 2 | Arm |

| Static track type note frequency | Representation |
|---|---|
| Every note | 1111111111111111 |
| Every other note | 1010101010101010 |
| Quarter note | 1000100010001000 |

Fig. 3

| Track setting | randomness | hits |
|---|---|---|
| XXXXXXXXXXXXXXXX | 0 | 0 |
| | 50 | 0-16 but likely ~8 |
| | 100 | 16 |
| 1XXX1XXX1XXX1XXX | 0 | 4 |
| | 50 | 4-16 but likely ~10 |
| | 100 | 16 |

Fig. 4

| | "X0X0X0X0X0X0X0X0" |
|---|---|
| Track 1 | "1010000000000000" |
| Track 2 | "1000100000000000" |
| Track 3 | "1000101010000000" |
| Track 4 | "1000101010000000" |
| Track 5 | "0000000000100010" |
| Track 6 | "0000000000101000" |

Fig. 6

| | "XXXX00000000000" |
|---|---|
| Track 1 | "1010000000000000" |
| Track 2 | "1001000000000000" |
| Track 3 | "1000000000000000" |
| Track 4 | "0001000000000000" |
| Track 5 | "0110000000000000" |
| Track 6 | "0010000000000000" |

Fig. 7

| Group | Track | Association |
|---|---|---|
| Group 1 | Track 1 | Leg |
| | Track 2 | Leg |
| Group 2 | Track 3 | Arm |
| | Track 4 | Arm |
| Group 3 | Track 5 | Arm |
| | Track 6 | Arm |

Fig. 11

| Notation | Interpretation |
|---|---|
| 0 | Off |
| 1 | On |
| 2 | On every other bar |
| 3 | On every 3 bars, starting with bar 1 |
| 4 | On every 4 bars, starting with bar 1 |
| 5 | On every 5 bars, starting with bar 1 |
| 6 | On every 6 bars, starting with bar 1 |
| 7 | On every 7 bars, starting with bar 1 |
| 8 | On every 8 bars, starting with bar 1 |
| 9 | On every 9 bars, starting with bar 1 |
| a | (Reserved) |
| b | On every other bar, starting on bar 2 |
| c | On every 3 bars, starting with bar 2 |
| d | On every 4 bars, starting with bar 2 |
| e | On every 5 bars, starting with bar 2 |
| f | On every 6 bars, starting with bar 2 |
| g | On every 7 bars, starting with bar 2 |
| h | On every 8 bars, starting with bar 2 |
| i | On every 9 bars, starting with bar 2 |
| j | On every 3 bars, starting with bar 3 |
| k | On every 4 bars, starting with bar 3 |
| l | On every 5 bars, starting with bar 3 |
| m | On every 6 bars, starting with bar 3 |
| n | On every 7 bars, starting with bar 3 |
| o | On every 8 bars, starting with bar 3 |
| p | On every 9 bars, starting with bar 3 |
| q | On every 4 bars, starting with bar 4 |
| r | On every 5 bars, starting with bar 4 |
| s | On every 6 bars, starting with bar 4 |
| t | On every 7 bars, starting with bar 4 |
| u | On every 8 bars, starting with bar 4 |
| v | On every 9 bars, starting with bar 4 |
| w | On every 5 bars, starting with bar 5 |
| x | Random based on half the random settings (the capital 'X' would use the full random settings as in previous examples). So, 50% chance (using 'X') would be treated as 25% chance using 'x'. |
| y | On every 6 bars, starting with bar 5 |
| z | On every 7 bars, starting with bar 5 |
| A | A: On every 8 bars, starting with bar 5 |
| B | On every 9 bars, starting with bar 5 |
| C | On every 6 bars, starting with bar 6 |
| D | On every 7 bars, starting with bar 6 |
| E | On every 8 bars, starting with bar 6 |
| F | On every 9 bars, starting with bar 6 |
| G | On every 7 bars, starting with bar 7 |
| H | On every 8 bars, starting with bar 7 |
| I | On every 9 bars, starting with bar 7 |
| J | On every 8 bars, starting with bar 8 |
| K | On every 9 bars, starting with bar 8 |
| L | On every 9 bars, starting with bar 9 |

Fig. 12a

| | |
|---|---|
| X | Random based on random settings |
| + | Continue the note that was last played. So, a 16th note would be played as an 8th note instead, likewise the notation "1+++1+++1+++1+++" would result in the playback for 4 quarter notes in one bar. |

Fig. 12b

ANATOMICAL RANDOM RHYTHM GENERATOR

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of random phrase and rhythm generators.

Background of the Invention

Music is a sonic art form. Music has many different genres and subgenres such as rock, rap, pop, classic among many others. Music can be made using a wide variety of different instruments. Some instruments commonly associated with making music are guitars, pianos, drums, or the mouth. Music of some form or another has been observed historically across nearly all cultures. Although nuanced, music seems to be a ubiquitous human activity.

A musical composition is a combination of sounds over time called rhythms. The rhythm may be comprised of coherent repetitive sounds or patterns from one or more instruments. The most fundamental musical pattern or beat underlies the entire rhythm. Generally, the beat captivates and compels a listener who often may sync their dancing with the beat. Aside from the beat there are other musical patterns intertwined and superimposed upon the beat which come together to make a rhythm.

Creativity is a trademark of human activity and an essential part of developing new things. Although other factors are present, creativity permeates the process of making something that did not exist before. Creativity manifests itself in human perception, expression, problem solving, and innovation. Good examples of human creativity may be found everywhere and are omnipresent in our lives today. Creative works of art are found in museums. Creative music may be heard on the radio and innovative music is ubiquitous. That said, being creative is difficult.

Creativity is inherently difficult and also nebulous. The creative process may be different for everyone and the process may be one that individuals must discover for themselves. Further, society harshly critiques new things and may have an aversion to new things which further dissuades individuals from embarking on the creative process.

Although most human activity is repetitive, the preeminent activities that define a person, time period, or culture are often creative. The same thing may be said for music. One great song may be played many times, but credit and creative ownership are attributed to the person who made the song and performed it first. Aside from being creative, musicians must be skilled enough to play their instruments. So, great music and great musicians must be both skilled in their instruments and have a creative approach to making music.

Traditionally making new rhythm components requires some element of creativity and skill on the part of the musician. Typically, new rhythms can be developed in one of three ways. 1) With a human drummer, 2) inputting a rhythm into a device called a drum machine manually or 3) by inputting a rhythm into a device called a drum machine by playing along in real-time. All the described methods of developing rhythms require some amount of creativity. However, many musicians struggle for creative song-writing inspiration or suffer from artist's block when trying to make new music.

Today, computers are heavily employed in music. Digital audio workstations may be used to mix, record, edit, and produce audio files. Computers may also be used to augment or replace human creativity in the music development process by creating music for musicians. Computers may generate music algorithmically by considering the inherent mathematical aspects of music. Computers are often used to perform very sophisticated audio synthesis using a wide variety of algorithms and approaches. Computers are so embedded in the music generation process that computer-based synthesizers, digital mixers, and effects units have become the norm.

There have been some limited attempts at random music or rhythm generators. Traditional rhythm generators may use probabilities to create a pattern or sound. Traditional generators, using probability alone, are prone to creating anatomically impossible rhythm tracks. For example, turning the probability setting up high enough on a traditional rhythm generator may result in a "machine gun" effect where all tracks are hitting in unison, which may be physically impossible to play. Such music or rhythm generators may also be structurally limited. The known random music or rhythm generators often only handle the common western four-four time signature. Thus, a need exists for a less structurally limited device to generate random anatomically possible rhythms to help a musician start or resume the creative process of making music.

SUMMARY OF THE INVENTION

In view of the foregoing, an object of this specification is to disclose a random music or rhythm generator that considers human anatomy. The generator may be comprised of hardware and software. The hardware device or host may leverage the software or algorithm. The algorithm may also be embedded in a 3$^{rd}$ party solution or other music software.

The algorithm has many purposes, one of these purposes being music or rhythm generation. The algorithm generates music or rhythm through a plurality of soundtracks or tracks.

The algorithm may act analogously to a player component of a player piano. The algorithm works by sending and returning note information through various software and hardware protocols. The algorithm may be tuned for rhythm creation (accounting for the number of arms and legs a human drummer has) but may be adapted to handle musical phrases based on other human factors like arms or fingers which would correspond to a human keyboard player.

The host is the other component of the generator. The host sets a plurality of musical parameters such as time signature, tempo, clock, song position, and the like. The host sends information related to the musical parameters to the algorithm. Then the algorithm produces an output that the host can use to generate sound directly or indirectly through various means.

The generator is distinct from other traditional rhythm generators by accounting for anatomic possibility when creating rhythm tracks. The generator and its software may generate hundreds of possible rhythms and phrases based on a plurality of settings in the software. However, the system can filter or prioritize rhythms for anatomic possibility. In other embodiments the musician can filter or prioritize rhythms instead of relying on the system. In other embodiments, the user may choose to not filter or prioritize rhythms.

RELATED ART

EP1994525B1 to Orr discloses a "Method and apparatus for automatically creating musical compositions."

JPH07230284 to Hayashi discloses a "Playing data generating device, melody generator and music generation device."

U.S. Pat. No. 3,629,480 to Harris discloses a "Rhythmic accompaniment system employing randomness in rhythm generation."

U.S. Pat. No. 3,958,483 to Borrevik discloses a "Musical instrument rhythm programmer having provision for automatic pattern variation."

U.S. Pat. No. 4,208,938 to Kondo discloses a "Random rhythm pattern generator."

U.S. Pat. No. 5,484,957 to Aoki discloses a "Automatic arrangement apparatus including backing part production."

U.S. Pat. No. 6,121,533 to Kay discloses a "Method and apparatus for generating random weighted musical choices."

U.S. Pat. No. 7,169,997 to Kay discloses a "Method and apparatus for phase controlled musical generation."

U.S. Pat. No. 7,491,878 to Orr discloses a "Method and apparatus for automatically creating musical compositions."

U.S. Pat. No. 7,790,974 to Sherwani discloses a "Metadata-based song creation and editing."

U.S. Pat. No. 8,566,258 to Pachet discloses a "Markovian-sequence generator and new methods of generating markovian sequences."

U.S. Pat. No. 8,812,144 to Balassanian discloses a "Music generator."

U.S. Pat. No. 9,251,776 to Serletic discloses a "System and method creating harmonizing track for an audio input."

U.S. Ser. No. 10/453,434 to Byrd discloses a "system for synthesizing sounds from prototypes."

U.S. Ser. No. 10/679,596 to Balassanian discloses a "Music generator."

US20020177997A1 to Le-Faucheur discloses a "Programmable melody generator."

US20030068053A1 to Chu discloses a "Sound data output and manipulation using haptic feedback."

US20060000344A1 to Basu discloses a "System and method for aligning and mixing songs of arbitrary genres."

US20090164034A1 to Cohen discloses a "Web-based performance collaborations base on multimedia-content sharing."

US20110191674A1 to Rawley discloses a "Virtual musical interface in a haptic virtual environment."

US20120312145A1 to Kellett discloses "Music composition automation including song structure."

US20150221297A1 to Buskies discloses a "System and method for generating a rhythmic accompaniment for a musical performance."

U.S. RE28,999 to Southard discloses a "Automatic rhythm system providing drum break."

WO2006011342A1 to Nakamura discloses a "Music sound generation device and music sound generation system."

WO2009107137A1 to Greenberg discloses a "interactive music composition method and apparatus."

WO2019158927A1 to Medeot discloses a "Method of generating music data."

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 3 shows static "track type" chart;

FIG. 4 shows a dynamic track setting, randomness, and hit chart;

FIG. 6 is a "track type" chart;

FIG. 7 is a "track type" chart;

FIG. 11 is a table;

FIG. 12*a* is an example of an encoding scheme; and,

FIG. 12*b* is a continuation of FIG. 12*a*.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a random music or rhythm generator that considers human anatomy as music is generated. The generator may be comprised of hardware and software. The hardware device or host may leverage the software or algorithm. The algorithm may also be embedded in a 3$^{rd}$ party solution or other music software.

The algorithm has many purposes, one of these purposes being music, rhythm or sound production. The algorithm produces its own sound through a plurality of soundtracks or tracks. The algorithm may act analogously to a player component of a player piano. The algorithm works by sending and returning note information through various software and hardware protocols. The algorithm may be tuned for rhythm creation but may be adapted to handle musical phrases based on human factors like arms or fingers which would correspond to a human keyboard player.

The host is the other component of the generator. The host sets a plurality of musical parameters such as time signature, tempo, clock, song position, and the like. The host sends information related to the musical parameters to the algorithm. Then the algorithm produces an output that the host can then use to generate sound directly or indirectly through various means.

The generator is distinct from other traditional rhythm generators by accounting for anatomic possibility when creating rhythm tracks. The generator and its software may generate hundreds of possible rhythms and phrases based on a plurality of settings in the software. However, the system will filter rhythms for anatomic possibility.

Figures 1, 2:
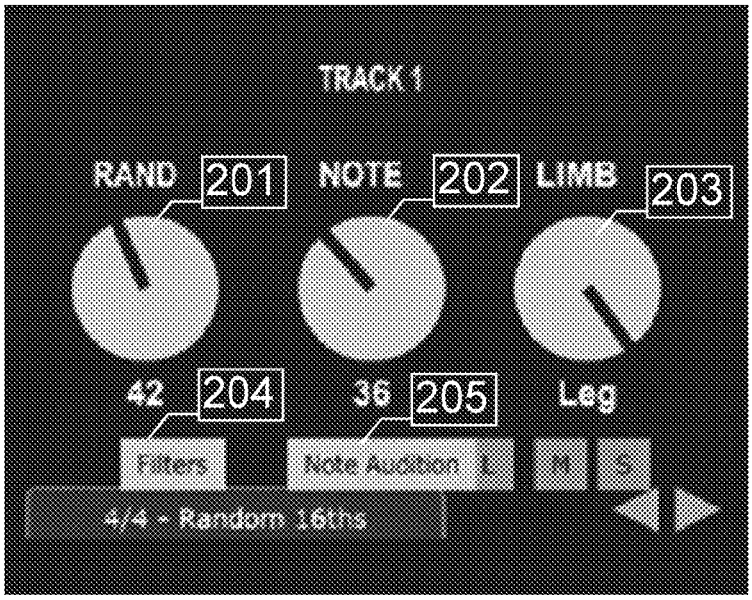
FIG. 1 shows a track, sound, and limb association chart.
FIG. 2 shows a track settings panel.

FIG. 1 shows a track, sound, and limb association chart. The chart shown is a representation of a plurality of percussion sounds produced by the anatomical random music or rhythm generator. The generator and algorithm as shown uses six tracks, however, the system may use between four and ten tracks. While four to ten tracks is a preferred setting, it may be possible for the system to use or process between zero to ten thousand or more tracks. Each track (in a preferred embodiment) may be connected to a drum or other instrumental machine synthesizer, which generates sounds like kick drums, snares, cymbal crashes, and the like. Suitably, the system can handle an unlimited number of tracks, e.g., between zero and ten-thousand plus.

The chart of FIG. 1 shows a moment in time, a plurality of tracks, a percussion sound associated with each track and a limb associated with each percussion sound. At this particular moment the music or rhythm generator is playing kick drums 1 and 2, snare drums 1 and 2, and crash cymbal 1 and 2. If a musician were to play the percussion sounds shown on the track chart on a physical drum set, the musician would simultaneously use their legs to hit kick drums 1 and 2 and their arms to hit snare drums 1 and 2 and crash cymbals 1 and 2.

The chart shown in FIG. 1 is an example of the anatomically impossible percussion sounds that random music or rhythm generators may prompt musicians to play. Traditional rhythm generators may use probabilities to create a pattern or sound. Traditional generators, using probability alone, are prone to creating anatomically impossible rhythm tracks such as the one shown by FIG. 1. Such rhythm tracks may be generated then filtered by the random anatomical musical generator disclosed by this application.

Tracks may have an associated limb or digit. Anatomical associations may allow the filter to create an anatomically possible output. Anatomical associations combined with a category called "track types" are what make the algorithm, and therefore the system, unique. Anatomical association settings may include arm, leg, finger, toe, or any. Using an arm or leg setting on multiple tracks restricts those tracks so that one limb cannot exceed two drum hits at the same time, reflecting anatomical realities.

While setting a track to a specific limb may create anatomical restrictions, setting a track to "any" may lift anatomical restrictions. For example, six tracks set to "any" could use every available sequence position and trigger six hits at the same time, throughout the entire sequence. Although this sequence may be busy and non-musical, it is an option. Similarly, setting all six tracks to arm would keep the rhythm simple, and no three tracks could be triggered at the same time.

FIG. 2 shows a track settings panel example. In one example, each of the tracks has its own individual settings that affect how rhythms are generated. The track settings may be track type, "track type" filter, limb, note, randomization, lock, and velocity minimum or maximum. These settings may be controlled by a randomness dial 201, a note dial 202, and a limb dial 203. Also shown is a filters tab 204 and a note audition tab 205. Although other settings may exist, they may not always affect rhythm generation.

An important track setting is "track types". "Track types"" are a category of track models that may classify specific tracks. The system may have an internal database of "track types" which represent rhythmic possibilities based on musical time signatures and other user selected settings. The database may contain an unlimited amount of "track types". "Track types" may be categorized as static, dynamic, or scripted.

FIG. 3 is a chart that speaks to a plurality of static "track types". For this track example, the time signature is set by the host to four-four. Typically, this means a sixteen-step sequence will be used in a single bar or musical phrase, but in other time signatures or settings, the number of steps can vary. The "track type" chart shows "track type" note frequency on the left column and shows the representation of that note frequency on the right column. The representation of the "track type" is represented with ones and zeros. Ones represent percussive hits and zeros represent the lack of a hit. As shown in the representation column, a static track may hit every note in the sequence, every other note in the sequence, or may hit only on quarter notes. Tracks do not need to be 16 steps, they can be 7, 14, 16, 32, up to 1024 and even larger in some use cases. FIG. 4 is a track setting, randomness, and hit chart that speaks to dynamic tracks. Like the previous static track example, the time signature is set by the host to four-four and the user or algorithm chose a sixteen-step sequence to be used in a single bar or musical phrase. Dynamic tracks differ from static tracks in that they incorporate a randomization setting. The randomization setting may range from zero to one hundred, with zero being no randomization and one hundred being the maximum. Whenever the "track type" on a track calls for a random element, the randomization setting is used. As shown in the "track type" chart of FIG. 4, the number of hits on a dynamic track is a function of track's settings and randomness. In the "track type" chart in the track setting column, Xs represent a random variable. If there are no Xs in the track type, then the randomness setting will not affect the output. The randomness column shows different degrees of associated randomness, and the hit column shows the number of percussive hits that may be generated by combining the track setting and randomness setting. Due to probabilities associated with randomization, a track setting with a randomization setting of seventy-five will likely have more hits than the same track with a randomization setting of ten.

The third "track type" is scripted tracks. Like the other "track type" examples, the time signature in this example is set by the host to four-four, A sixteen-step sequence was selected by the user or algorithm to be used in a single bar or musical phrase. A scripted track uses a dynamic scripting language to generate rhythms that are more complex than static and dynamic rhythms. Scripted tracks are highly configurable and open-ended, allowing for parametric possibilities such as, "at least four hits but no more than seven, and ensure one space exists between all notes". Or, "sixteen hits, each hit being progressively louder in order to create a sonic ramping effect".

Figure 5:
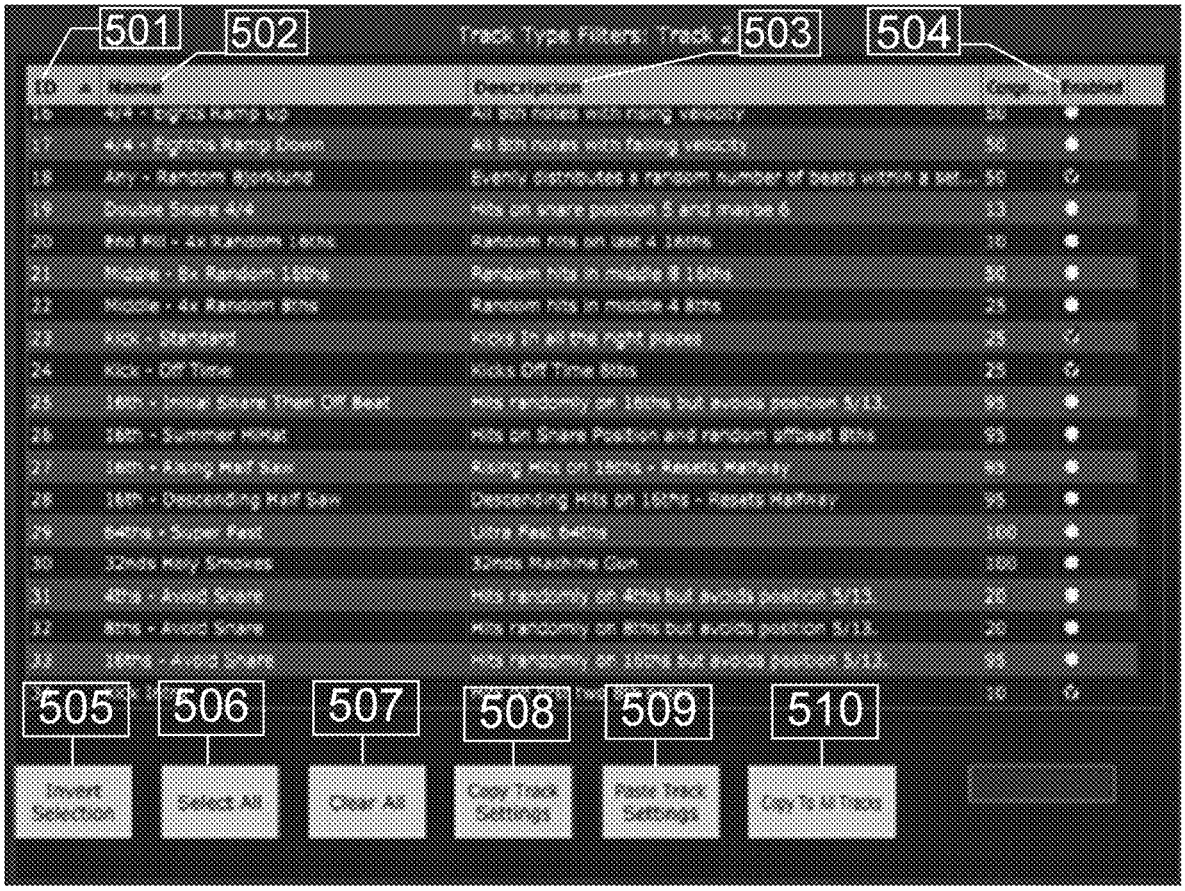
FIG. 5 shows a "track type" filter page.

FIG. 5 shows a "track type" filter page wherein tracks may be combined or filtered. The "track type" filters page may feature a list of "track type" filters that may be organized by ID: number 501, name 502, description 503, and enablement 504. Different icons such as the "invert selection" icon 505, "select all" icon 506, "clear all" icon 507, "copy track settings" icon 508, "paste track settings" icon 509, and "copy all tracks" icon 510 are shown on the lower portion of the "track type" filters page.

"Track types" may be useful for creating sonic structure. If "track types" and settings are combined in a preset, similar "track types" may create a different feel from one preset to the next. For instance, a user may mix various "track types" among the user's X tracks to generate rhythms that are busy, sparse and minimalistic, or somewhere in-between.

To store "track types" the software may feature an internal database. If the user wants a desired effect, the "track type" filter allows the user to select which "track types" may be eligible to play on a specific track. The user may set a single "track type" to be eligible to be played on a track or a user may select a group or pool of eligible "track types" and select "track types" randomly from the pool. It is important to note that only one "track type" is active on a given track at a time.

FIG. 6 is an example output and "track type" chart which speaks to a combination of six tracks with a track type, "X0X0X0X0X0X0X0X0." As shown the myriad of tracks correspond to the track type, "X0X0X0X0X0X0X0X0" because the tracks have hits in places that correspond to the "track types" variability.

FIG. 7 is a "track type" chart which speaks to a combination of six tracks with a track type, "XXXX000000000000." As shown the myriad of tracks correspond to the track type, "XXXX000000000000" because the tracks have hits in places that correspond to the "track types" variability, the table shows the results for each track based on the "track type" "definition" after being processed.

The ability to filter tracks types is a key element of music composition using the system. Using a filter, track 1 may be set to allow a group of "track types" that are different from the group track 2 allows, which are different than groups of "track types" allowed for the other tracks. In one example, when tracks are randomized, while each of the four to ten tracks of this example are using a different track type, the user may create an exponential amount of variation. It is important to note that filters may be inclusive or exclusive and that not all tracks have to be set to allow the same "track types". As stated above, the amount of randomized tracks may preferably be four to ten, but in other embodiments the amount used or employed may be between zero and ten thousand or more.

Using a combination of settings provided by the host and the track settings, sequences may be generated automatically in order to create a supply of rhythmic variation. Again, the sequence generator considers anatomical restrictions and the "track type" on each track, to generate multi-track patterns that are anatomically possible if limb associations are proper. Without limb associations the tracks are randomly built and assembled into a multi-track sequence.

When the user is satisfied with an outcome they may save or lock tracks into their current generated pattern. Locked patterns will not be affected by updates or by the user further randomizing the pattern.

Tracks may have an associated note that is triggered any time a hit is required. In digital music, this is normally a musical instrument digital interface protocol often referred to as a "note number", which can range from 0-127. Note numbers may communicate pitch information across instruments. In a hardware control-voltage scenario, pitch information may need to be conveyed using control voltage output rather than the note number. In this case, the host can take the note number and make the necessary conversion before sending it to the output. The algorithm may trigger specific sounds through the host using the note setting. In the prototype, the note is tied to a track in a 1:1 relationship. However, the 1:1 ratio is configurable and there are creative use cases where the ratio may change over time.

Digital communication between the algorithm and the host is an important part of the system. It is often the case that the host may provide song position to the algorithm whereby the algorithm sends back the elements of the currently created pattern that correspond to the bar or song position. Thereafter, the host is responsible for routing those notes to downstream synthesizers. Alternatively, the algorithm can generate a file or structure that allows the host to play the notes. In many use cases, the host would also record the output from the algorithm in order to play it back the same way, in the future, without the algorithm needing to be present. It is also possible for the algorithm to record and store these internally for later use depending on the embodiment.

Figure 8:
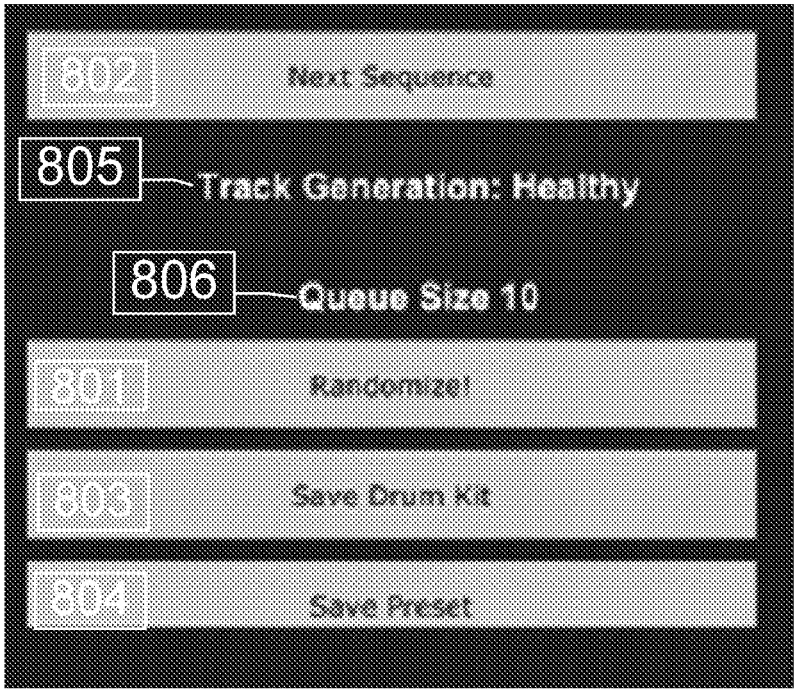
FIG. 8 shows to a configuration page.

Two ways the user may change a pattern may be by using a randomize icon 801 or a next sequence icon 802 shown in FIG. 8. Pressing the randomize icon 801 will cause the generator to randomly select a "track type" for each track based on available types set in the "track type" filter and build a new set of sequences based on the given track settings. Pressing the next sequence icon 802 causes the generator to produce a variation of the existing settings that leaves "track types" unchanged. A pattern may have subtle variations when the next sequence icon 802 is selected and may be completely rearranged if the randomize icon 801 is selected. Track generation quality may be monitored by a track quality indicator 805. Further, queue size may be monitored by the queue size indicator 806. When the user is satisfied with the outputs the user may save their settings using a save drum kit icon 803 or a save preset icon 804.

If the pattern is still not satisfactory, a user may select a different pattern from saved "track types" and settings or from some other preset configuration. Presets may add creative direction to the otherwise random process of making music which the system employs. Presets may come preloaded on the system and may be created or shared by users.

Presets may also be generated in a random fashion via a "make everything random" icon. Using the "make everything random" icon may combine all "track types" in a random preset. When the "make everything random" icon is selected, all tracks will load their respective track filters and generate random patterns.

A drum kit is a collection of notes that correspond to tracks and an important tool for making music digitally. Drum kits may also be an important part of the system. Drum kits are useful when the user has many drum machines in their collection. Often, drum kits are changed. Changing the drum kit may change the notes on each track to correspondent notes in the drum kit. Changing the drum kit may not affect the sequence process or the song position. Drum kits may be changed many times while the sequence is being played without affecting the overall rhythm. However, changing drum kits may change the notes or sounds being played.

Figure 9:
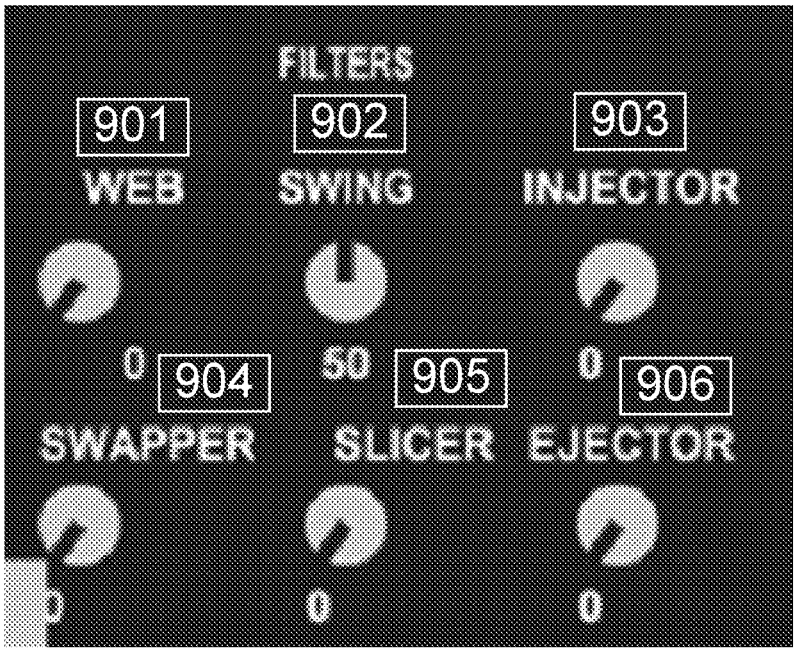
FIG. 9 shows a filters page.

FIG. 9 shows a filters page. As shown, the filters page features a web filter 901, a swing filter 902, an injector filter 903, a swapper filter 904, a slicer filter 905, and an ejector filter 906. The filters may be non-binary and may be modulated. During playback or sequence generation, several real time and build filters can be used to change the overall feel or structure of a multi-track sequence by interacting with a portion of the sequence called the active sequence. The filters may remove notes, add slight delays in notes, inject notes, swap notes between tracks, split notes into two new notes, change the note number or pitch on a note, or other creative use cases. A slight delay in notes or swing is popular and may be found in other drum machines and software. However other filters by the system are not common or known.

Build filters are used when the pattern is generated or re-built based on various events, and playback filters are designed for "real-time" changes to the actively playing sequence. Neither filters need to permanently modify the underlying structure of the pattern, and each type of filter may have its own settings. For example, a "note injector" may have a setting of 90 out of 100, which may indicate there is a 90% chance it will create a new note during playback during any particular playback interval. It may also have settings for the maximum number notes it will create during a single pattern playback.

A build filter, for example, may use a generated sequence, then "drop" or otherwise silence a particular percentage of notes in the sequence. If the pattern were set to repeat 10 times in a row, the same notes that were silenced would be silenced each and every time, so each of the 10 playbacks would be identical. The notes silenced would be "permanent" until the sequence is rebuilt or the build filter's settings are changed and the new settings take effect.

Playback filters are for real-time changes or live performance. For instance, a real-time filter may add one or more notes to a sequence as it's playing back. However, playback filters don't have a "memory", so setting the pattern to repeat 10 times in a row may result in experiencing 10 slightly different variations of the underlying pattern as nothing was permanently changed during playback and events are simply changed or added in a random fashion. The level of randomness is part of the filter's own settings. Additional features of the system may be related to the algorithm, QR codes, and the hardware element of the system. The algorithm may use artificial intelligence and machine learning to learn and make decisions based on user preferences or data stored in another medium or another computer network. The algorithm may generate settings or sequences as a QR code to allow easy import, export, and sharing of settings and sequences between users. The hardware may have the ability to send and receive presets or sequences via QR codes or wirelessly. The hardware may connect to the cloud in order to share and receive presets and sequences from other users of the platform.

Figure 10:
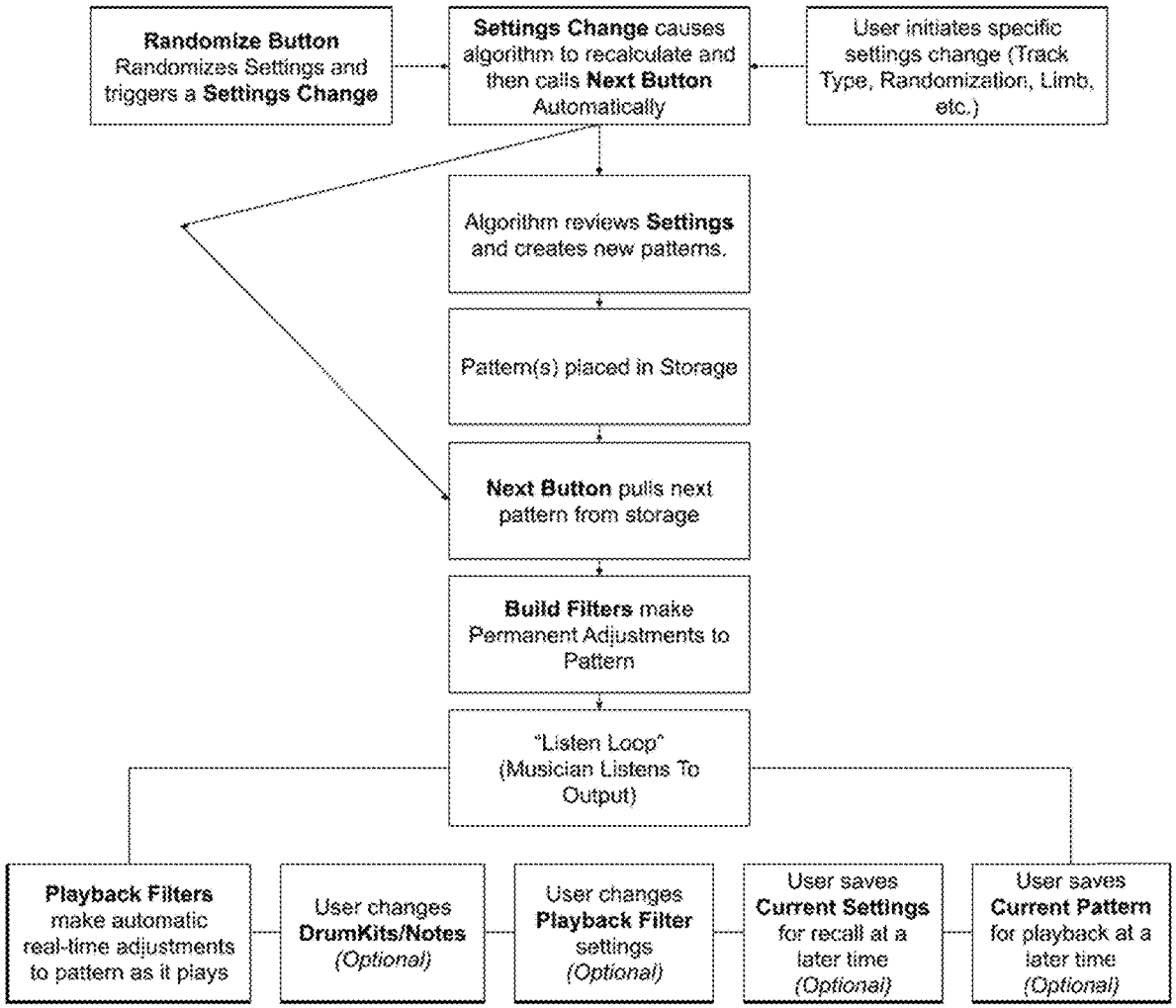
FIG. 10 is a flow chart.

FIG. 10 is a flow chart that speaks to the steps of building and configuring a pattern. One may start this process by pressing a randomize button. The randomize button randomizes settings and triggers a settings change. Thereafter, tracks may be configured by the user via track settings. Configurable track settings may be randomization, track type, "track type" filter, limb, note, randomization, lock, and velocity minimum or maximum. These changes in settings cause the algorithm to recalculate and call the next button automatically. The algorithm reviews the settings and creates new patterns. Then the new patterns are stored. Simultaneously, the next button pulls the next pattern from storage. Next, build filters may make semi-permanent adjustments to the pattern. Then the pattern enters a listen loop, which is a cycle of listening and refinement on the part of the user. During this cycle, the user may use playback filters to make automatic real-time adjustments to the pattern as it plays. The user may change drumkits or notes. The user may change playback filter settings. Patterns may be further configured and changed with build filters. Once the user is satisfied with the "way" that patterns are generated (based on settings, filters, etc.) the settings themselves can then be saved for future recall as a "preset". Future patterns can then be generated under the same criteria by recalling the "preset" settings. The patterns generated (the order of notes, timing, velocity, etc.) would likely be different than when the settings were originally saved. Lastly, the user may save the current pattern when they are satisfied with the pattern outcome.

If the user is satisfied with the pattern itself (the series of notes, etc.) the pattern can also be saved for future recall. Saving the pattern for future recall can be useful if the musician is away from their studio or is using the device for live performance.

The user may change drum kits at this point and the change will be reflected in the saved pattern if the user desires FIG. 11 shows a track group, track, and limb association chart. As shown, tracks are categorized into track groups. The purpose of the chart shown is to disclose how track groups may be used to generate random anatomically possible patterns or rhythms. Groups may create anatomically possible patterns and rhythms by preventing groups from colliding pursuant to user settings. It should be noted that the chart is in no way intended to be limiting of the subject matter disclosed in this specification. Although the terms "Group," "Track", "Leg", and "Arm" are used, it should be understood that other terms or designators (e.g., colors) for a group, composition, or appendage could be used to organize the relevant information contained within the table.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of using a system to randomly generate music that is performable by human with a first limb and a second limb defined as either an arm or leg, said method comprising:

identifying a system for music generation comprised of an algorithm and a host wherein (i) the host is defined by computer hardware coupled to computer readable memory and is configured to (a) set at least a first time signature and a second time signature of a musical track (b) send the first and second time signatures to the algorithm, and (c) generate a first note and a second note defined respectively by a first percussion sound and second percussion sound such that the first and second notes are respectively generated directly or indirectly through first or second drum machines that have been coupled to the host;

(ii) the algorithm is software installed on the computer readable memory and is configured to (a) respectively associate the first and second time signature, the first and second notes, and the first limb and the second limb and (b) store in a database the respective association of the first and second time signatures, the first and second notes, and the first and second limbs as respectively a first moment in time for the track and a second moment in time for the track;

randomly configuring via the algorithm a first track via track settings to set the first time signature, the first note defined by the first percussion sound from the first drum machine, and the first limb associated with the first time signature and the first note;

storing via the algorithm the association of the first time signature, first note, and first limb in the database as the first moment in time of a first track;

specifically creating via the algorithm and host an anatomical association of a second track via configuring the second track via the track settings to set the second time signature, the second note defined by the second percussion sound from the second drum machine, and the second limb associated with the second time signature and the second note;

storing via the algorithm an association of the second time signature, second note, and second limb in the database as the second moment in time of the second track;

combining and filtering the first and second tracks such that (a) the first and second moments in time for the first and second track coincide and (b) the first and second limb are different.

2. The method of claim 1 wherein the combination of the first and second tracks defines a first pattern and further comprising the system automatically generating a second pattern via combining a third and fourth tracks where the third track has a third moment in time defined by a third time signature, a third note, and a third limb and the fourth track has a fourth moment in time defined by a fourth time signature, a fourth note, and a fourth limb, wherein the first and second time signatures are different than the third and fourth time signatures, and wherein the first and second limbs are the same as or different than the third and forth limbs.

3. The method of claim 2 wherein the algorithm is configured to randomly select the sounds that define the third and fourth notes, the method further comprising randomizing via the algorithm the third and fourth notes of the first and second patterns using a randomize command icon on a user interface that is configured to initiate the algorithm's process of randomly selecting the sounds that define the third and fourth notes.

4. The method of claim 3 where in the algorithm is configured to randomly select a leg or arm as the first, second, third and fourth limb, the method further comprising the first and second patterns being randomized according to anatomical associations of the first, second, third, and fourth limbs to create patterns that are performable by human anatomy.

5. The method of claim 4 further comprising saving the first and second patterns in the database.

6. The method of claim 5 further comprising reconfiguring via the algorithm the first and second patterns via designation by the user of the first, second, third and fourth limbs.

* * * * *